US005474714A

United States Patent [19]

Pirck et al.

[11] Patent Number: 5,474,714

[45] Date of Patent: Dec. 12, 1995

[54] NON-POLLUTING SHOCK ABSORBER AND LEVEL CONTROLLER FLUIDS

[75] Inventors: Dietrich Pirck, Seevetal; Hans-Dieter Grasshoff, Hamburg, both of Germany

[73] Assignee: RWE-DEA Aktiengesellschaft für Mineraloel und Chemie, Germany

[21] Appl. No.: 256,750

[22] PCT Filed: Jan. 19, 1993

[86] PCT No.: PCT/DE93/00049

§ 371 Date: Jul. 22, 1994

§ 102(e) Date: Jul. 22, 1994

[87] PCT Pub. No.: WO93/15167

PCT Pub. Date: Aug. 5, 1993

[30] Foreign Application Priority Data

Jan. 25, 1992 [DE] Germany ..... 42 02 034.4

[51] Int. Cl.[6] ..... C10M 105/34; C10M 129/70

[52] U.S. Cl. ..... 252/56 S; 252/56 R; 252/73

[58] Field of Search ..... 252/56 S

[56] References Cited

U.S. PATENT DOCUMENTS

| | | | |
|---|---|---|---|
| 2,757,139 | 7/1956 | Matuszak et al. | 252/56 S |
| 4,957,648 | 9/1990 | Yodice et al. | 252/56 S |
| 5,091,270 | 2/1992 | Ohya et al. | 252/56 S |
| 5,286,397 | 2/1994 | Schmid et al. | 252/56 S |

FOREIGN PATENT DOCUMENTS

| | | |
|---|---|---|
| 3521711 | 12/1986 | Germany . |
| 88/05809 | 8/1988 | WIPO . |
| 88/05808 | 8/1988 | WIPO . |
| 91/03531 | 3/1991 | WIPO . |

OTHER PUBLICATIONS

Patent Abstracts of Japan, vol. 7, No. 268, Nov., 1989 of JP 58–148,836–A.

*Primary Examiner*—Ellen M. McAvoy
*Attorney, Agent, or Firm*—David L. Mossman

[57] ABSTRACT

The present invention relates to hydraulic fluids which are particularly intended for shock absorption and level controlling applications in vehicles. Hydraulic fluids are provided which substantially consist of esterification products of monosaturated fatty acids and 2-alkyl-1-alkanols. The claimed fluids comply with the requirements made on industrial hydraulic media and are particularly outstanding by their good biodegradability.

5 Claims, 1 Drawing Sheet

VISCOSITY vs. TEMPERATURE (by Ubbelohbe)

Series Oil ———— Example 3 - - - - - - - - - - - -

VISCOSITY vs. TEMPERATURE (by Ubbelohbe)

Series Oil ———— Example 3 - - - - - - - - - -

NON-POLLUTING SHOCK ABSORBER AND LEVEL CONTROLLER FLUIDS

FIELD OF THE INVENTION

The present invention relates to non-polluting shock absorber and level controller fluids which are particularly intended for use in vehicles and which consist of one or more base stocks and additives.

BACKGROUND OF THE INVENTION

Prior-art shock absorber and level controller fluids, particularly used in vehicles, are select mineral oil fractions in combination with suitable lubricant additives. Said fluids are also termed in the following 'automotive hydraulic fluids'. Generally, these fluids meet the requirements with respect to shock absorption and ageing resistance. However, their biodegradation is not sufficiently rapid and their ecotoxicological characteristics are unsatisfactory so that they have a considerably polluting impact on the environment. Since, particularly with shock absorbers, uncontrollable oil leakage frequently occurs, environmentally acceptable shock absorber fluids are badly required.

Therefore, it was first attempted to substitute the petroleum products in question with natural materials, e.g. vegetable oils.

PCT publication WO 88/08808 describes hydraulic fluids based on natural triglycerides and a combination of vegetable oils with synthetic esters as adjusting agents for lowering or increasing the viscosity. However, the low-temperature behavior of these products, too, remains significantly above the values required of automotive hydraulic fluids.

For instance, rape and sunflower oil have high lubricating powers and excellent viscosity temperature (VT) behaviors, whereas their ageing and low-temperature properties are unsatisfactory so that these materials were inappropriate as substitutes.

Polyethylene glycols are used to a limited extend in universal industrial hydraulic applications, but such fluids are not suitable for automotive applications because their low-temperature fluidities and compatibilities with conventional lubricants are unsatisfactory.

Finally, for use in shock absorbers, saturated dicarboxylic acid esters and polyol esters have been examined which, although they presented yet sufficient degradation rates and good thermal stabilities, had viscosity indices (VI) which were significantly lower than the values obtained with natural oleic acid esters. Furthermore, when using NBR (nitrile butadiene rubber), a material which is normally used in technical applications, the elastomer swelling behavior is inacceptable.

U.S. Pat. No. 2,757,139 of the year 1953 discloses synthetic ester oils as lubricants for use in aircraft gas turbines. The experimental part of said patent publication only relates to esters of coconut fatty acids with $C_{16}$, $C_{26}$ Guerbet alcohols tested as turbine lubricating oils. The esters described in said publication have insufficient VI indices for the application of the invention (max. 148) so that considerable amounts of VI improvers have to be added to reach values of higher than 150. In addition, the fluidities and low-temperature behaviors of said esters are unsatisfactory. No ecological requirements are made on the products.

SUMMARY OF THE INVENTION

Therefore, it was the object of this invention to provide shock absorber and level controller fluids which fulfill the technical and strict ecological demands made on such products, particularly with respect to biodegradability.

In carrying out these and other objects of the invention, there is provided, in one form, hydraulic fluids for shock absorption and level controlling in vehicles having (1) esterification products of oleic acid and 2-alkyl-1-alkanols with 12 to 20 carbon atoms as biologically degradable base fluids; and (2) ecologically compatible additives.

DETAILED DESCRIPTION OF THE INVENTION

Figure 1:
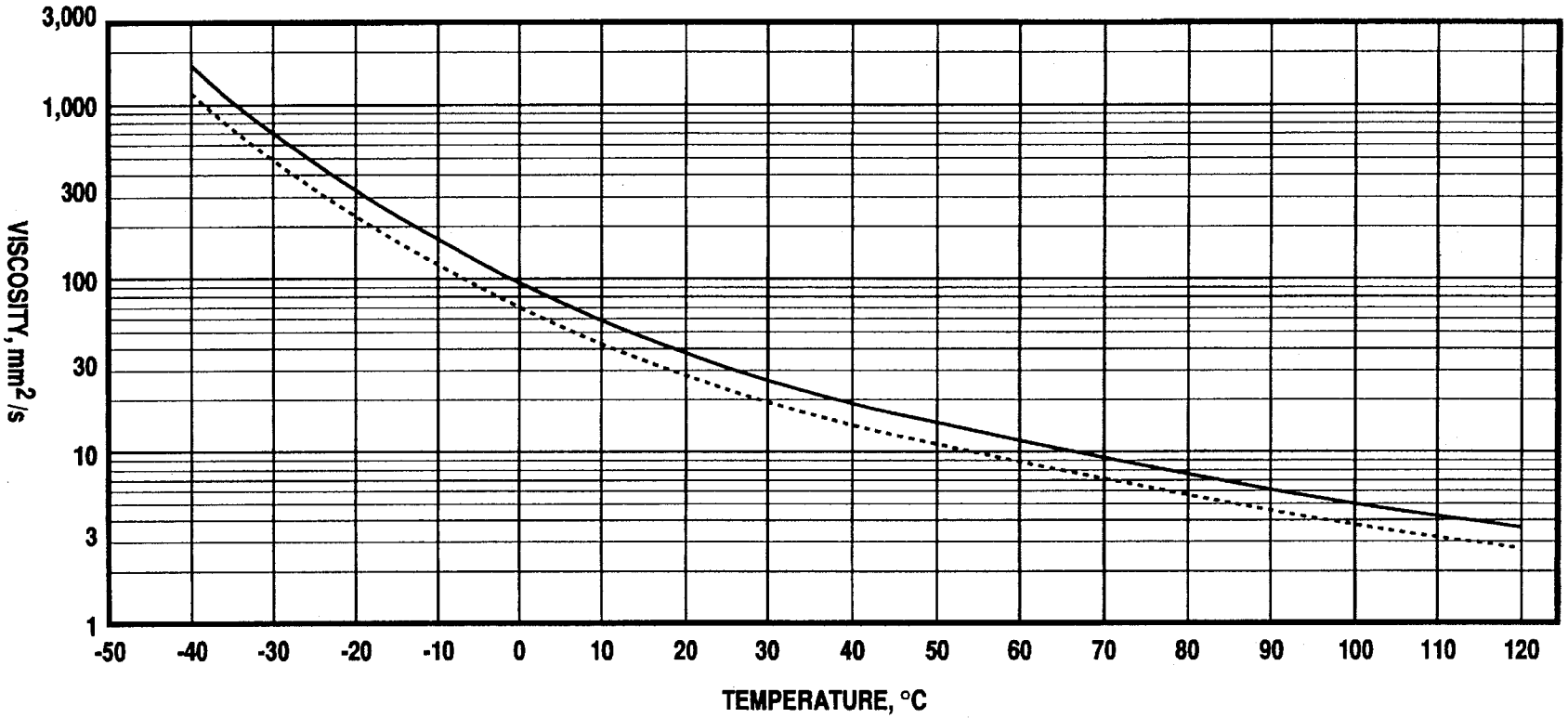
FIG. 1 is a viscosity-temperature curve of the inventive fluid of Example 3 ranging from –40° C. to +120° C. in comparison with a conventional shock absorber oil.

According to the present invention, the problem is solved by using esterification products of oleic acid and 2-alkyl-1-alkanols comprising 12 to 20 carbon atoms as biodegradable base stocks and ecologically compatible additives as fluids for the shock absorption and level control, particularly of vehicles.

The alkanol components preferably comprise 12 to 16 carbon atoms. In particular, oleates are used the alkanol component of which is a mixture of said alcohols.

According to an embodiment of the present invention, the fluids also contain prior-art base stocks besides the base stock(s) of this invention.

It was surprisingly found that the products obtained by esterification of oleic acid with the aforesaid 2-alkyl-1-alkanols not only present highly satisfactory biodegradabilities and excellent ecological compatibilities but also comply in an exceptionally satisfactory way with the technical requirements when used as hydraulic fluids. In particular, the following criteria are relevant:

a) viscosity range at 20° C.: from about 20 to 35 $mm^2/s$ b) optimum viscosity-temperature (VT) behavior, viscosity index (VT)=at least 150 c) good low-temperature fluidity at –40° C., max. 2,000 mPa.s, pour point below –40° C.

d) low volatility, 1 h/150° C./<5% e) sufficient thermal ageing stability up to at least 130° C.

f) sufficient sealing material resistance

With respect to the ecological compatibility, the following demands are made:

a) highest possible biodegradability in conformity with CEC-L-33-T82, at least 80% b) water contamination rating: 0 (zero)

c) none of the constituents of such fluids is allowed to have a hazardous material classification or a water contamination rating of >1

The aforementioned requirements are met by the hydraulic fluids of the present invention. Special attention is drawn to the following characteristics:

exceptionally high biodegradability surprisingly good thermal ageing resistance favorable viscosity-temperature behavior excellent low-temperature fluidity at –40° C.

The exceptionally high biodegradability of the branched esters used according to this invention is surprising since, in general. C-chain branching is said to inhibit degradation.

The base stocks according to the present invention are manufactured as known per se by esterification, e.g. in the presence of zirconium or titanium catalysts and entraining agents, and by a stripping process. They are preferably comprised of ester mixtures of oleic acid. The oleic acid may contain small amounts of linoleic acid and of linolenic acid.

The following compounds of the group of 2-alkyl-1-alkanols are preferably used:

2-butyl octanol, 2-hexyl decanol, 2-butyl decanol, 2-octyl decanol, 2-hexal octanol, 2-hexyl dodecanol, 2-octyl dodecanol.

The general formula of the 2-alkyl-1-alkanols used is:

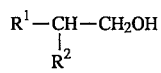

wherein $R_1$ is the linear main chain, an alkyl with 8 to 12 carbon atoms, preferably 8 to 10 carbon atoms, and branched with the linear side chain $R_2$, an alkyl with 4 to 8 carbon atoms, preferably 4 to 6 carbon atoms. They are known as Guebet alcohols and are accessible by technical processes.

In order to improve in the individual case the specific properties of the hydraulic fluids, customary additives are added to the esterification products, particularly up to 5 percent by weight of ecologically compatible additives, referring to the total quantity of hydraulic fluid, among others antiageing agents, antiwear agents, corrosion inhibitors and antifoaming agents. These constituents are selected according to the requirements of the field of application, e.g. shock absorbing systems for automobiles, industrial vehicles, railroad cars.

In another embodiment of the invention, the hydraulic fluids of the invention contain 0.1 to 5 weight percent of the ecologically compatible additives, related to the total composition of the hydraulic fluids.

EXAMPLES

In each of the following examples ecotoxicologically acceptable additives (water contamination rating=max. 1) were added, namely 1% of an antioxidant, a commercial mixture of hydroxylated aromatic hydrocarbons, and 1% of an antiwear agent, a commercial phosphoric acid ester.

The esters used and the results of the comparative experiments have been compiled in Tables 1 and 2. Listed in the following are the characteristics and the test methods used for determination:

| | |
|---|---|
| Viscosity | DIN 51562 |
| Viscosity index (VI) | DIN-ISO 2909 |
| Pour point (PP) | DIN-ISO 3016 |
| Evaporation (Noack Test Procedure) | DIN 51581 |
| Standard reference elastomer: NBR-1, swelling in volume over a period of 168 hours at 100° C. | |
| Wear characteristics (four-ball tester) | DIN 51350 T5 |
| Biodegradability after 21 days | CEC L-33-T-82 |
| Artificial ageing of lubricating oils at 120° C. in the presence of iron chips | |

EXAMPLE 1 (Comparison)

In comparison with the hydraulic fluids according to the present invention, refined rape oil presented an excellent viscosity-temperature behavior (viscosity index), but the low-temperature properties (Table 1) were not acceptable for outdoor use.

EXAMPLE 2 (Comparison)

A synthetic, commercial polyoleate based on a polyololeic acid ester having an iodine number of 48 and a saponification number of 265 (oleate ester A) only barely missed the viscosity range and low-temperature requirements (Table 1). However, considerable ageing symptoms and a higher tendency to swelling (Table 2) were found.

EXAMPLE 3 (according to the invention)

The synthetic oleate ester B based on technical-grade oleic acid of the following characteristics:

| Analysis | Test Method | Value |
|---|---|---|
| Acid number, mg KOH | DGF C-V 2 | 200 |
| Iodine number, gJ/100 g | DGF C-V 11b | 95 |
| Unsaponifiables, % | DGF C-III 1a | 0.9 |
| C-Chain Distribution (Gas Chromatographic) | | |
| $C_{12}$–$C_{16}$ | — | 6.0% |
| $C_{18}$ | Stearic acid | 1.0% |
| $C_{18}'$ | Oleic acid | 80.0% |
| $C_{18}''$ | Linoleic acid | 11.5% |
| $C_{18}'''$ | Linolenic acid | 0.5% |
| $>C_{18}$ | — | 1.0% |

has the following alkanol composition:

2-Butyloctanol oleate: 15%

2-Butyldecanol oleate: 50%

2-Hexyldecanol oleate: 35%

Biodegradability is almost 100%.

The measurements showed results which met the technical requirements. Depicted in FIG. 1 is the viscosity-temperature curve ranging from –40° C. to +120° C. In comparison with a conventional shock absorber oil (series oil).

Moreover, long-time shock absorber test runs were carried out at 85° C. (1 million strokes). The oil ageing was found to be low. In a triple test the following results were obtained:

a) Low-Temperature Function/Sealing Test

Filled shock absorbers were stored during 24 hours at –40° C. and then were actuated at max. 0.52 m/s up to a temperature of +120° C. The test was passed by the inventive fluid.

b) Friction/Graunz Test

Filler shock absorbers were examined for frictional noise by slowly moving the piston rod in and out at short strokes. The test was passed by the inventive fluid.

c) Shock Absorption

Filled shock absorbers were exposed to stroke rates of between 0.01 and 0.52 m/s at temperatures of from –40° C. to 180° C.

d) Long-Time Test Run

Filled shock absorbers were subjected to a beat frequency of 1/12 Hz over a period of 500 hours. Mechanical wear, changes in the absorbing power and possible oil losses were evaluated.

$1\times10^6$ strokes at 85° C.

Oil loss 1%.

Increase in viscosity +4.5% at 40° C.

The other comparative examples were carried out using the following commercially available fluids:

Example 4 (Comparison) Diisodecylazelaic acid ester
Example 5 (Comparison) Di-ethylhexylsebacate
Example 6 (Comparison) Dialkylazelaic acid ester
Example 7 (Comparison) Trimethylolpropane complex ester
Example 8 (Comparison) Polyethylene glycol

TABLE 1

Hydraulic Oils for Motor Vehicles Biodegradable Products (I)

| Example | Type | Viscosity 20° C. $mm^2/s$ | Viscosity 100° C. $mm^2/s$ | VI | Viscosity −20° C. $mm^2/s$ | Viscosity −30° C. $mm^2/s$ | Viscosity −40° C. $mm^2/s$ | PP °C. |
|---|---|---|---|---|---|---|---|---|
| 1 | Vegetable oil, modified | 68 | 7.5 | 214 | 775 | 2,976 | — | −33 |
| 2 | Synthetic oleate ester A | 50 | 5.2 | 170 | 680 | 1,650 | — | −45 |
| 3 | Synthetic oleate ester B | −27 | 3.8 | 183 | 230 | 490 | 1,140 | −48 |
| 4 | All-synthetic esters A | 21 | 3.0 | 143 | 195 | 450 | 1,250 | −70 |
| 5 | All-synthetic esters B | 24 | 3.2 | 146 | 230 | 540 | 1,500 | −70 |
| 6 | All-synthetic esters C | 40 | 4.6 | 160 | 520 | 1,380 | 4,400 | −70 |
| 7 | All-synthetic esters D | 33 | 3.7 | 134 | 360 | 860 | 1,860 | −51 |
| 8 | Polyglycol ether | 79 | 5.4 | 123 | 2,250 | 8,720 | 47,730 | −50 |

TABLE 2

Hydraulic Oils for Motor Vehicles Biodegradable Products (II)

| Example | Type | Noack 150° C. 1 h % | NBR-1 %-vol. | Four-Ball Tester 630 N mm | CEC L-33-T-82 % | Ageing 312 h, 120° C. %-visc. | Ageing 624 h, 120° C. %-visc. |
|---|---|---|---|---|---|---|---|
| 1 | Vegetable oil, modified | −0.6 | +9.2 | 0.53 | 97 | +9.2 | +24.4 |
| 2 | Synthetic oleate ester A | −0.6 | +27 | 1.0 | ~92 | +10.5 | +42.9 |
| 3 | Synthetic oleate ester B | −0.5 | +9.1 | 0.86 | 99 | +4.0 | +11.8 |
| 4 | All-synthetic esters A | −0.6 | +40 | 0.66 | ~91 | +0.1 | +0.1 |
| 5 | All-synthetic esters B | −0.6 | +35 | 0.63 | ~90 | +/−0 | +0.7 |
| 6 | All-synthetic esters C | −0.6 | +31 | 0.71 | 97 | +/−0 | +2.4 |
| 7 | All-synthetic esters D | −0.9 | +35 | 0.75 | 99 | +/−0 | +0.1 |
| 8 | Polyglycol ether | −2.3 | +10.7 | 0.50 | ~85 | +0.9 | +4.6 |

We claim:

1. A method of using esterification products in a hydraulic fluid in vehicles, comprising the steps of:

preparing esterification products of oleic acid and 2-alkyl-1-alkanols with 12 to 20 carbon atoms as biologically degradable base fluids having:

a viscosity index of at least 150;

a pour point equal to or less than −40° C.; and a maximum viscosity of 2,000 mPa.s at −40° C.;

combining the esterification products with ecologically compatible additives to form a hydraulic fluid; and adding the hydraulic fluid to vehicles.

2. The method of claim 1, whereby the 2-alkyl-1-alkanols of the esterification products contain 12 to 16 carbon atoms.

3. The method of claim 1, whereby the 2-alkyl-1-alkanols of the esterification products are mixtures of more than one 2-alkyl-1-alkanol.

4. The method of claim 1, whereby besides one or more of the biologically degradable esterification product base fluids there are also present known biologically degradable conventional base fluids.

5. The method of claim 1, whereby the hydraulic fluids contain 0.1 to 5 weight percent of the ecologically compatible additives, related to the total composition of the hydraulic fluids.

* * * * *